US005442884A

United States Patent [19]

Nicholas

[11] Patent Number: 5,442,884

[45] **Date of Patent: * Aug. 22, 1995**

[54] FIRE-RATED CORNER GUARD STRUCTURE

[75] Inventor: John D. Nicholas, Lawrenceville, Ga.

[73] Assignee: Pawling Corporation, Pawling, N.Y.

[ * ] Notice: The portion of the term of this patent subsequent to Nov. 29, 2011 has been disclaimed.

[21] Appl. No.: 307,527

[22] Filed: Sep. 16, 1994

Related U.S. Application Data

[60] Division of Ser. No. 210,725, Mar. 17, 1994, Pat. No. 5,367,850, which is a continuation of Ser. No. 905,044, Jun. 26, 1992, abandoned.

[51] Int. Cl.[6] ..... E04F 13/06

[52] U.S. Cl. ..... 52/516; 52/232; 52/515; 52/517

[58] Field of Search ..... 52/232, 516, 517, 515, 52/317, 461

[56] References Cited

U.S. PATENT DOCUMENTS

| | | | |
|---|---|---|---|
| 3,183,626 | 5/1965 | Schmitt | 52/395 |
| 3,331,171 | 7/1967 | Hallock | 52/278 |
| 3,372,521 | 3/1968 | Thom | 52/395 |
| 3,435,574 | 4/1969 | Hallock | 52/278 |
| 3,670,470 | 6/1972 | Thom | 52/395 |
| 3,696,575 | 10/1972 | Armstrong | 52/288.1 |
| 3,864,886 | 2/1975 | Thom | 52/469 |
| 3,866,370 | 2/1975 | Guarino et al. . | |
| 3,915,777 | 10/1975 | Kaplan . | |
| 4,706,426 | 11/1987 | Rumsey . | |
| 4,778,544 | 10/1988 | Jones et al. . | |
| 4,901,488 | 2/1990 | Murota et al. . | |
| 4,932,179 | 6/1990 | Sosinski . | |
| 5,103,609 | 4/1992 | Thoreson et al. . | |

OTHER PUBLICATIONS

Technical Information "PyroBar SI-90" Fireresistant Paint For Steel, 1 page.

*Primary Examiner*—Wynn E. Wood

*Attorney, Agent, or Firm*—Schweitzer Cornman & Gross

[57] ABSTRACT

A fire-resistant wall structure is provided with a recessed corner guard, for absorbing impact forces, particularly at an external corner. To compensate for the relative loss of fire-resistance capability, in the area in which the wall structure is recessed to receive the corner guard structure, surfaces within the recess are provided with a layer of intumescent paint which, when exposed to sufficiently elevated temperature, expands to develop a thick, cellular foam providing a highly effective insulating layer. The intumescent paint is applied directly to surfaces of an extruded aluminum structural element installed in the recess. Preferably, the paint is applied at the factory where the corner guard components are manufactured. Significant economies and other benefits are realized in relation to prior practices of installing ceramic matting in the wall recess at the construction site.

4 Claims, 1 Drawing Sheet

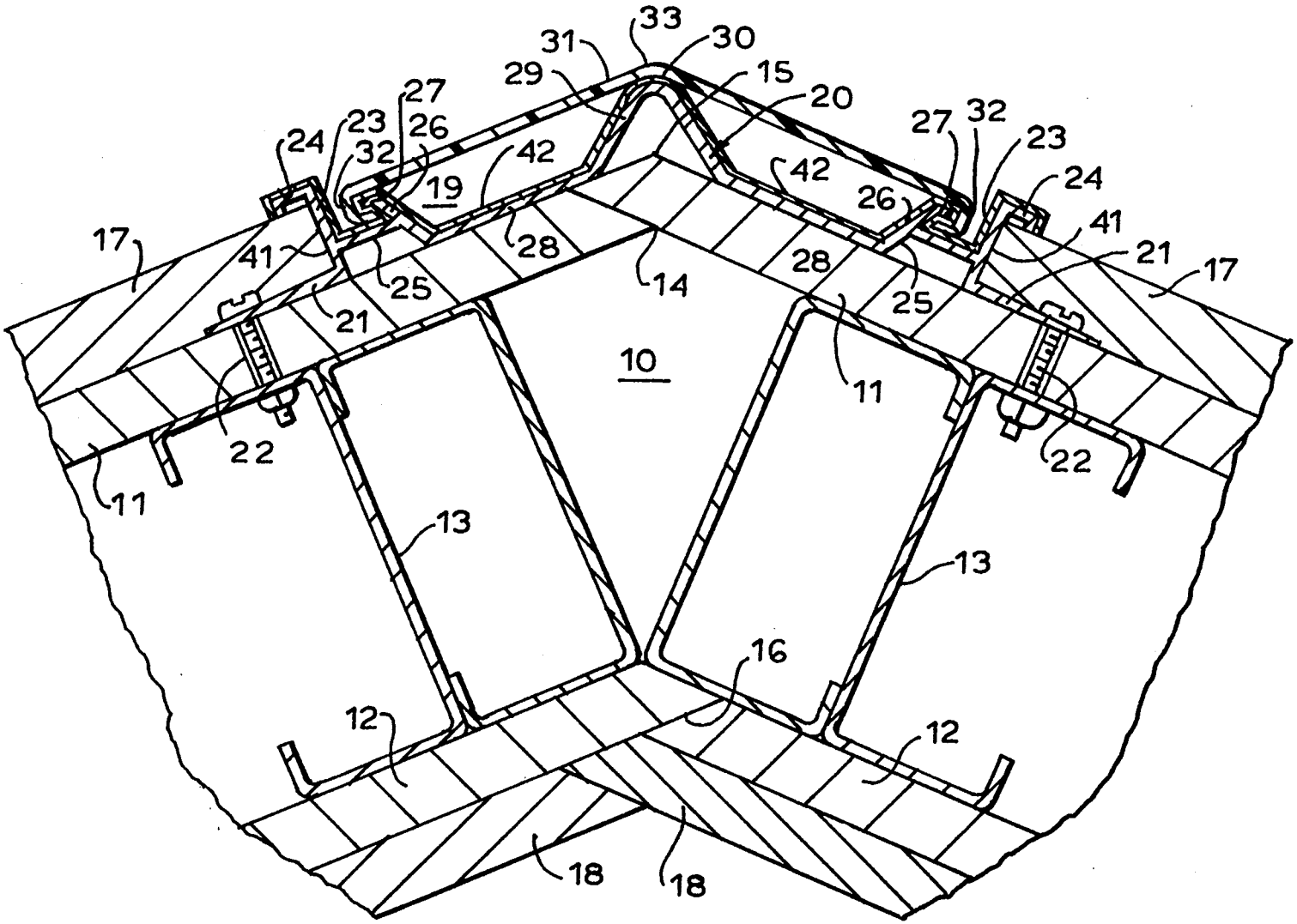
10
11
12
13
14
15
16
17
18
19
20
21
22
23
24
25
26
27
28
29
30
31
32
33
41
42

FIRE-RATED CORNER GUARD STRUCTURE

RELATED APPLICATIONS

This application is a division of my application Ser. No. 210,725, filed Mar. 17, 1994, now U.S. Pat. No. 5,367,850. Application Ser. No. 210,725 was a continuation of my prior application Ser. No. 905,044, filed Jun. 26, 1992, now abandoned.

BACKGROUND AND SUMMARY OF THE INVENTION

The present invention is directed to the design and construction of a recessed corner guard arrangement, for incorporation in a fire-rated wall, providing a flush mounted installation, while at the same time assuring the fire-rated capability of the wall structure.

In many institutional an other structures, where there is likely to be traffic in wheeled carts, wheelchairs, and the like, special corner guard installations are provided at external corners in hallways and the like to minimize the effects of impact from vehicles and the like moving through the hallways. In many cases, it is preferred that the corner guard installation be recessed in the wall structure, so that the outer surface of the external corner guard element is substantially flush with the primary wall surfaces adjacent to the corner guard installation.

When a wall is constructed according to a fire-rated standard, the rating is a function of the materials used in the construction of the wall. In order to provide a recessed corner guard installation, it is necessary to provide a suitable recess in the primary wall structure which, other things being equal, would reduce the fire-rating of the wall in the region of the recess.

Prior practice in the installation of recessed corner guard facilitates in fire-rated wall structures typically has involved the installation of a ceramic mat in the corner recess provided for the flush mounted corner guard. The ceramic mat has an intumescent characteristic which, in the presence of heat from a fire, expands to provide an insulating characteristic which can serve as an acceptable substitute for the thermal resistance of the wall material that otherwise would occupy the recessed area. The Rumsey U.S. Pat. No. 4,706,426 is an example of such a prior construction.

While the prior art installations may be acceptable in terms of fire-rating, there is a substantial penalty in terms of both the cost and difficulty of installation. The ceramic mats employed have a tendency to flake and crumble easily, and are thus a very difficult medium to work with at a typical construction site.

In accordance with the present invention, a fire-rated recessed corner guard installation is provided, which can be expeditiously installed with little or none of the cost penalty associated with the use of ceramic mats. To this end, one or more surfaces of the recess, or of the recessed corner guard installation, are coated with a layer of intumescent paint. The intumescent paint, which forms a highly insulative foam char in the presence of fire, performs largely the same function as the ceramic mat, in terms of restoring the firerated capability of a recessed area of a fire-rated wall, yet eliminates the significant cost and complications involved with the installation of ceramic matting, for example.

For a more complete understanding of the above and other features and advantages of the invention, reference should be made to the following detailed description of preferred embodiments of the invention and to the accompanying drawing.

DESCRIPTION OF THE DRAWING

The single FIGURE of the drawing is a fragmentary cross sectional view of an external corner of a fire-rated wall, provided with a recessed corner guard installation constructed in accordance with the invention.

DESCRIPTION OF PREFERRED EMBODIMENTS

Referring now to the drawing, the reference numeral 10 designates generally a wall structure of a fire-rated design. In a typical installation, front and back panels 11, 12 of gypsum sheet rock are secured in spaced relation by conventional metal studs 13, which may correspond to conventional two by fours, for example. A pair of front wall panels 11 are overlappingly joined at 14 to form an external corner 15. Likewise, the back panels 12 of sheet rock are overlappingly joined at 16 to form an internal corner.

It will be understood that additional studs 13 are installed at spaced locations along the wall structure to support the panels 11, 12 in the desired, spaced-apart manner over an extended area.

To provide for a fire-rating of, for example, two hours, as determined by ASTM Test E-119, it is typical to construct the opposite walls of two layers of sheet rock panel. Thus, the front wall panel structure includes sheet rock panels 17, which are laid over the panels 11, and the opposite-side panel structure includes sheet rock panels 18, laid over the panels 12. The structure thus provided, comprising two spaced-apart panel structures, each comprising two layers of $\frac{5}{8}$ inch thick Type-X gypsum sheet rock, generally satisfies the desired two hour rating.

At external corners, it is common to provide protection against impact, as these locations commonly are bumped into by wheeled carts, wheel chairs, etc. If left unprotected, the relatively soft sheet rock panels quickly become damaged and unsightly. For the sake of appearance, it is often desired to install a recessed corner guard structure, the outer surface of which is generally level with the outer surface of the outer sheet rock panel 17. Such recessed corner guard structures are well known in themselves. By way of example only, a recessed corner guard of the general type illustrated herein is commercially available from Pawling Corporation, Pawling, N.Y., under its model designation CG-75.

Where a recessed corner guard structure is employed, a recess, generally designated by the reference numeral 19, is provided at the external corner, either by trimming back the ends of the respective outer sheet rock panels 17, or installing them in the first instance to terminate a predetermined distant short of the corner juncture 15. A relatively rigid metal retainer member 20, typically constructed of extruded aluminum, is mounted in the recess. As shown in the drawing, the illustrated retainer includes laterally extending mounting flanges 21, 22, which overlie the sheet rock panels 11 and are secured to the outermost sheet metal studs 13, by means of toggle bolts 22 or the like. Vertical abutment walls 23 extend from the inner edges of the mounting flanges 21 and form abutment surfaces against which the end extremities of the outer sheet rock panels 17 may be abutted. Short confining flanges 24 join with the upper extremities of the abutment flanges 23 and extend over and confine the outer marginal end portions of the sheet rock panels 17.

Horizontal webs 25 extend from the abutment walls 23 into the recess 19 and integrally join with retainer sidewalls 26, which are provided at their upper extremities with outwardly projecting retaining lips 27. The sidewalls 26 join with bottom walls 28 arranged to bear upon the outer surfaces of the inner sheet rock panels 11, defining the bottom of the recess 19. The bottom walls 28 in turn merge with upwardly and inwardly projecting corner supports 29 joined together at the top by a rounded support surface 30.

A cover member 31, constituting by a continuous extrusion of rigid vinyl, of, for example, 0.093 inches in thickness, extends over the aluminum retainer 20 and has return flanges 32 at its opposite outer edges arranged to be snapped over and engaged and retained by the projecting lips 27 of the aluminum retainer 20. In the normal, at-rest configuration of the retainer 20 and cover 31, the cover lies somewhat loosely over the retainer. Sufficient tolerance is provided in the sizing of the cover 31 to allow it to be pressed downward against the supporting surface 13 far enough to spread the return flanges 32 to clear the ends of the retaining lips 27. When the pressure is released, the vinyl cover assumes a position, with the returns 32 pressing tightly against the retainer lips 27 and the apex 33 of the cover spaced outwardly from the supporting surface 13 of the aluminum retainer. If desired, a resilient compression element (not shown) may be interposed between the support surface 30 of the retainer and the overlying surface of the cover 31. In either case, there is sufficient looseness or play in the vinyl cover 31 to allow it to deflect under impact and absorb normal forces of impact without damaging the corner.

As previously mentioned, when a recessed corner guard structure of the general type just described is mounted in a fire-rated wall, one of the four layers of sheet rock paneling are missing from the area of the recess 19, potentially reducing the fire-rated classification of the completed wall. Heretofore, this weakness has been rectified by installing in the recess an underlayment in the form of a mat of ceramic material. While this modification adequately restores the fire-rating of the wall, it is costly and difficult to install, and requires the handling of a delicate and fragile ceramic mat in the rough and tumble environment of a construction site.

In accordance with the present invention, the fire-rating of the recessed corner guard installation is established by providing a painted-on coating of intumescent or endothermic material. If desired, this can be applied at the job site, in which case it would be applied as a painted-on layer 40 on the outer, exposed surface of the recess 19, as defined by the sheet rock panels 11 and perhaps also the end wall surfaces 41 of the sheet rock panels 17. Alternatively, and perhaps preferably, the retainer 20 and/or the cover 31 may be pre-coated at the factory with a layer of the desired intumescent paint, as indicated at 42 in the drawing, so that nothing further is to be done at the job site. Where parts are pre-coated at the factory, installation of the fire-rated recessed corner guard structure is identical to installation of a conventional recessed corner structure. Even where the intumescent paint coating is to be applied at the job site, the matter of applying a coat of paint to the recessed corner area is far easier and more economical than attempting to install a fragile ceramic mat. And, of course, there is little or no problem storing a can of paint at a construction site. However, the handling of a fragile ceramic mat at a construction site can be a significant problem. Pursuant to the invention, it is generally adequate to apply a painted coating of about 2 mils in thickness of the intumescent paint. Such paints are available from known sources. A representative and preferred example of such, suitable for the practice of the present invention, is PyroBar SI-90, sold by American Vamag Company Inc., of Ridgefield, N.J. PyroBar SI-90 is an intumescent, fire resistant paint frequently used for the protection of steel. When exposed to temperature of 350° F. or greater, the paint develops a thick, rigid foam, which acts as a highly effective insulating layer.

The present invention enables important economies to be realized in the installation of fire-rated walls, where recessed corner guards are employed. Whereas heretofore, such installations required the time consuming, laborious and costly installation of ceramic mats, in order to achieve the necessary level of fire resistance, the structure of the present invention incorporates a coating of intumescent paint, which can be easily applied at the construction site, if desired, or can be pre-applied at the factory. Either way, installation of the wall structure according to the invention is far more economical and satisfactory than using previously known construction techniques.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A fire and impact resistant corner and wall assembly comprising a fire and impact resistant corner structure installed in a fire resistant wall structure, the fire resistant wall structure being comprised of layers of fire resistant material and including an external corner and having a recess in said layers at said external corner where the fire resistant character of said corner structure is reduced, and having an impact resistant structure mounted in said recess, where said impact resistant structure includes a metal retainer strip mounted in said recess and a plastic cover member installed in said recess and secured by said retainer strip, characterized by, (a) said metal retainer strip being a section of extruded aluminum having an inwardly facing surface and an outwardly facing surface, (b) the fire resistance of said external corner being enhanced by at least one of said inwardly or outwardly facing surfaces of said extruded aluminum retainer strip being provided with a surface coating of intumescent paint capable of expanding and forming an insulating layer in said recess in response to the presence of fire, and (c) said surface coating of intumescent paint having a thickness of at least about two mils.

2. The fire and impact resistant corner and wall assembly fire resistant wall structure according to claim 1, further characterized by (a) said wall structure comprising a plurality of layers of sheet rock material, (b) an outer one of said layers of sheet rock being arranged to terminate at and to define said recess, (c) said wall structure at said recess having fewer layers of said sheet rock material than other regions of said wall structure.

3. The fire and impact resistant corner and wall assembly fire resistant wall structure according to claim 2, further characterized by (a) said fire resistant wall structure comprising at least two layers of sheet rock panels on each side of a central space, and (b) said recess being formed by removing an outer one of the layers on one side of said central space.

4. The fire and impact resistant corner and wall assembly fire resistant wall structure according to claim 1, further characterized by, (a) said at least one surface of said aluminum retainer strip comprising said outwardly facing surface thereof.

* * * * *

UNITED STATES PATENT AND TRADEMARK OFFICE

CERTIFICATE OF CORRECTION

PATENT NO. : 5,442,884
DATED : August 22, 1995
INVENTOR(S) : John D. Nicholas

It is certified that error appears in the above-indentified patent and that said Letters Patent is hereby corrected as shown below:

Columns 4, 5 & 6, claims 2 - 4, line 2, delete "fire resistant wall structure"

Signed and Sealed this

Twenty-fifth Day of June, 1996

*Attest:*

Bruce Lehman

BRUCE LEHMAN

*Attesting Officer*

*Commissioner of Patents and Trademarks*